United States Patent [19]

Berger

[11] Patent Number: 4,655,393

[45] Date of Patent: Apr. 7, 1987

[54] HIGH VOLUME ULTRASONIC LIQUID ATOMIZER

[75] Inventor: Harvey L. Berger, Poughkeepsie, N.Y.

[73] Assignee: Sonotek Corporation, Poughkeepsie, N.Y.

[21] Appl. No.: 834,646

[22] Filed: Feb. 27, 1986

Related U.S. Application Data

[63] Continuation of Ser. No. 455,900, Jan. 5, 1983, abandoned.

[51] Int. Cl.[4] ..... B05B 3/14

[52] U.S. Cl. ..... 239/102.1

[58] Field of Search ..... 239/101, 102, 4

[56] References Cited

U.S. PATENT DOCUMENTS 3,756,575 9/1973 Cottel ..... 239/102

4,153,201 5/1979 Berger et al. ..... 239/102

4,388,343 6/1983 Voss et al. ..... 239/4

*Primary Examiner*—Andres Kashnikow

*Assistant Examiner*—Scott D. Malpede

*Attorney, Agent, or Firm*—M. Lawrence Oliverio; Jerry Cohen

[57] ABSTRACT

An ultrasonic liquid atomizer particularly for high volume flow rates is disclosed. An enlarged tip with a plurality of orifices is provided to increase the flow rate. A gradual transition to the enlarged atomizer tip is provided to enhance performance. The atomizer provides a substantially cylindrical or slightly conical spray pattern and is particularly suited for use in a vertical orientation with the tip facing upwardly or in horizontal orientations. Titanium alloy bolts are used to clamp the front and rear sections of the atomizer together resulting in significant energy reduction and essentially eliminating bolt shearing.

11 Claims, 8 Drawing Figures

Fig. 5.
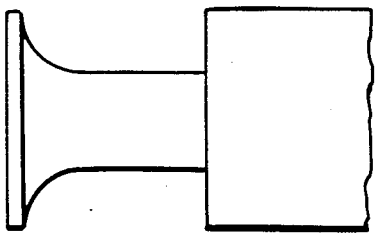
Fig. 6.
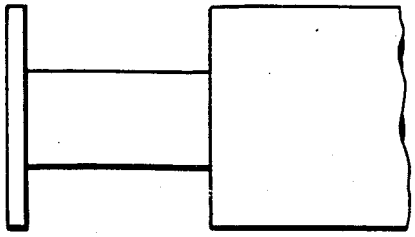
Fig. 7.
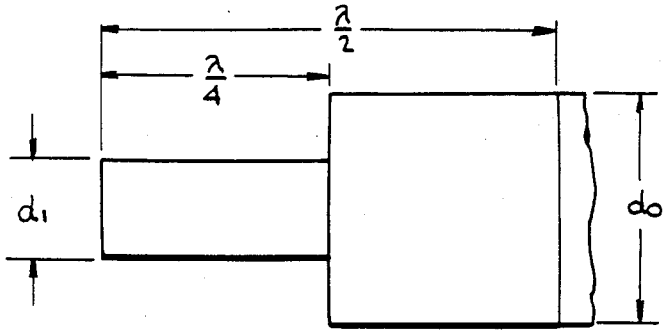
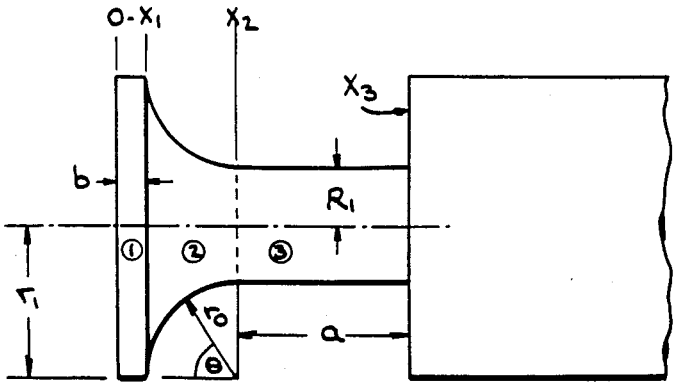
Fig. 8.

HIGH VOLUME ULTRASONIC LIQUID ATOMIZER

This is a continuation of application Ser. No. 455,900, filed Jan. 5, 1983, now abandoned.

BACKGROUND OF THE INVENTION

This invention relates to ultrasonic transducers, particularly to ultrasonic liquid atomizers and high volume ultrasonic liquid atomizers.

It is known that the geometric contour of the atomizing surface of an ultrasonic liquid atomizer influences spray pattern and density of particles developed by atomization, and that increasing the surface area of the atomizing surface can increase liquid flow rates. See, for example, U.S. Pat. Nos. 3,861,852 issued Jan. 21, 1975; 4,153,201 issued May 8, 1979; and 4,337,896 issued July 6, 1982. It is further known, from the aforementioned patents, for example, that the atomizing surface area can be increased by providing a flanged tip, i.e. a tip of increased cross-sectional area, which includes the atomizing surface, and that the contour of the tip can affect spray pattern and density.

OBJECTS AND SUMMARY OF THE INVENTION

It is an object of the present invention to increase the flow rate of an ultrasonic atomizer.

It is another object of the present invention to increase the flow rate of an ultrasonic atomizer while obtaining a spray pattern having a uniform dispersion of atomized particles, particularly a cylindrical or conical spray pattern.

It is another object of the present invention to provide an ultrasonic liquid atomizer having an increased flow rate which can be satisfactorily operated in any attitude, particularly with the atomizer tip facing vertically upwardly or horizontally.

It is a further object of the present invention to reduce the power consumption of ultrasonic transducers, particularly liquid atomizers.

It is another object of the present invention to improve clamping of the front and rear sections of an ultrasonic transducer.

The above and other objects are achieved in accordance with the invention disclosed herein. Simply substantially enlarging the surface area of the atomizing surface and/or the orifice size of a single orifice liquid atomizer to substantially increase the flow rate has been found to be unsatisfactory, not only because the resulting spray is unsatisfactory, but also because of structural failure considerations. Accordingly, the invention in one of its aspects not only provides an atomizing surface of increased surface area but also a plurality of orifices through the atomizing surface for delivering liquid to the atomizing surface. Each orifice of the plurality is in communication with an individual or separate liquid feed passage extending from the atomizing surface to a common liquid feed passage through which liquid is supplied to all of the individual liquid feed passages. Each orifice and its corresponding individual liquid feed passage are preferably of the same cross-sectional area and shape.

The surface area of the atomizing surface is increased by providing an enlarged tip. Both the enlarged tip and the adjacent section form part of an atomizer front section. The adjacent section is preferably stepped down from the remainder of the front section in order to provide amplification of the magnitude of the acoustical waves from the remainder of the front section to the stepped section.

In accordance with an aspect of the invention, a transition from the stepped section to the enlarged tip for coupling or connecting the two is provided which increases gradually from the stepped section to the enlarged tip. Such a transition reduces stresses in the stepped section due to a cantilever action of the enlarged tip which could cause cracking in the stepped section itself or in the connection of the stepped section to the flanged tip and/or the connection of the stepped section to the remainder of the front section.

In a preferred embodiment, the front section is of tubular shape and the enlarged tip is disc-shaped, the orifices are equally spaced, are of equal diameter and are disposed in the central portion of the enlarged tip.

In a preferred arrangement, the orifices are disposed about the circumference of one or more concentric circles with the orifices disposed about each circumference being equally spaced from each other. Moreover, all of the orifices are preferably equally spaced from each other. The atomizing surface may also include an orifice located in the center of the circle. Preferably, each orifice has the same diameter and the orifices are disposed about the circumferences of two concentric circles, six equally- spaced orifices being disposed about the smaller of the circles and twelve equally-spaced orifices being disposed about the larger of the circles, with the orifices of the smaller and larger circles preferably being offset. Such an orifice arrangement produces a substantially cylindrical spray pattern of a diameter roughly equivalent to the diameter of the atomizing surface.

It has been found that neither the common nor any of the individual liquid feed passages need be provided with decoupling sleeves previously employed in a single orifice atomizer to prevent premature atomization of liquid. It is believed that a number of orifices provides an averaging effect which tends to dampen in a random way instabilities associated with the spray when not decoupled, thereby eliminating the need for decoupling sleeves.

The invention in another of its aspects provides improved clamping of the front and rear sections of a transducer which reduce the power consumption of the transducer.

It was heretofore necessary to use high strength steel bolts or screws for clamping sections of an ultrasonic atomizer together. However, when increasing the size of the atomizer tip there was a tendency for the steel bolts to break after only a short period of use, apparently due to the large amount of energy transferred to them and their low compliance, i.e. their inability to yield sufficiently when stressed.

The improved clamping is achieved by the use of titanium alloy bolts or screws for bolting the front section and rear sections together. Surprisingly, the titanium alloy bolts dramatically reduce losses and do not fracture during use as do hardened steel bolts.

The titanium alloy bolts can achieve the above advantages and improvements while being used in combination with or independently of an enlarged tip and/or a plurality of orifices in a liquid atomizer, for different size and different flow rate atomizers, and in ultrasonic transducers other than liquid atomizers.

The above and other aspects, features, objects and advantages of the present invention will be more readily perceived from the following description of the preferred embodiments when considered with the accompanying drawings and appended claims.

BRIEF DESCRIPTION OF THE DRAWINGS

The present invention is illustrated by way of example and not limitation in the figures of the accompanying drawings in which like numerals indicate similar parts and in which:

FIGS. 5–8 are side views of portions of the front section of ultrasonic transducers which are useful in a mathematical analysis of the atomizer of FIG. 1;

FIG. 5 depicts a flared transition from the stepped section to the enlarged tip;

FIG. 6 depicts an abrupt transition from the stepped section to the enlarged tip;

FIG. 7 illustrates a mathematical model for a stepped horn front section; and FIG. 8 illustrates a mathematic model for an enlarged tip, a stepped horn section and a flared transition therebetween.

DESCRIPTION OF THE PREFERRED EMBODIMENTS

While liquid atomizers embodying the invention illustrated herein are particularly adapted for use as fuel burners, the invention is not limited to such atomizers and to use therewith, and liquid atomizers incorporating the invention disclosed herein can be used for other purposes such as for feeding fuel into internal combustion or jet engines, or for feeding fuel for combustion thereof to obtain the products of the combustion, for atomization of liquid other than fuel, such as water and paint, and for the atomization of liquids for many purposes such as fog or mist-making, irrigation, agricultural spraying (pesticides, herbicides, fungicides), spray drying processes for separating solids from liquids in which they are dissolved, mixed or otherwise carried, dust suppression, steam de-super heating for controlling super-heated steam, and other purposes.

Moreover, while the preferred embodiments of the invention illustrated herein depict liquid atomizers of the type having a liquid feed passage extending axially therethrough as described in U.S. Pat. No. 4,352,459 issued on Oct. 5, 1982, the disclosure of which is incorporated herein by reference, the invention is applicable to ultrasonic atomizers having other liquid feed arrangements, for example radial liquid feed passages exemplary of which is the one disclosed in aforementioned U.S. Pat. No. 4,153,201, the disclosure of which is also incorporated herein by reference.

Figure 1:
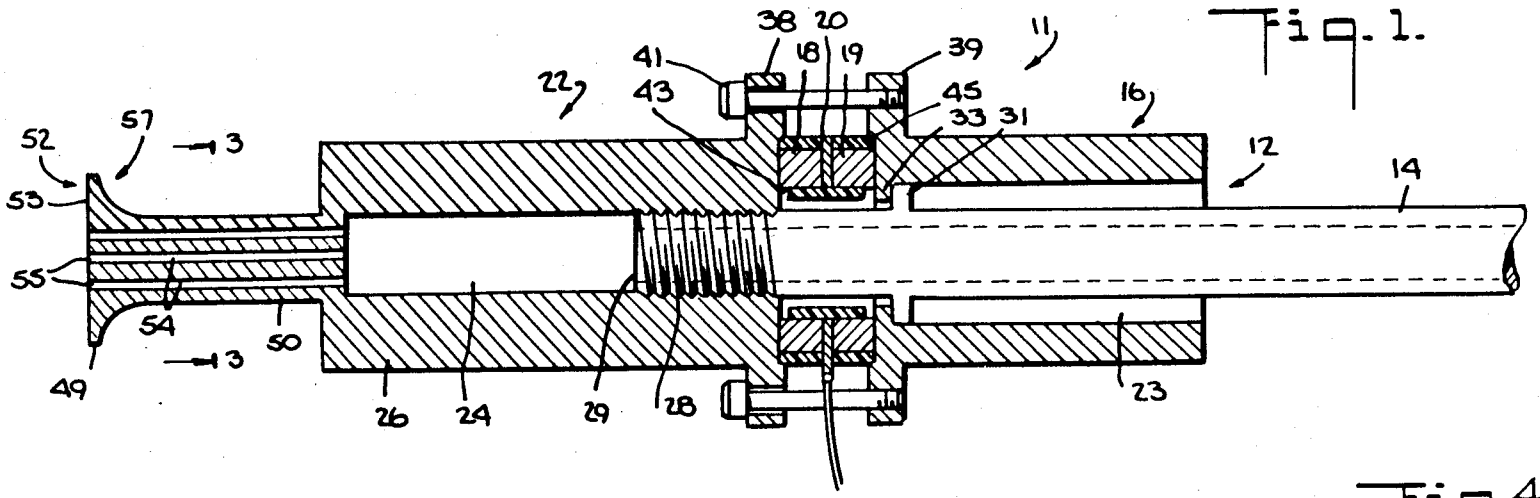
FIG. 1 is an axial section view of an ultrasonic liquid atomizer constructed in accordance with the present invention.
Figure 4:
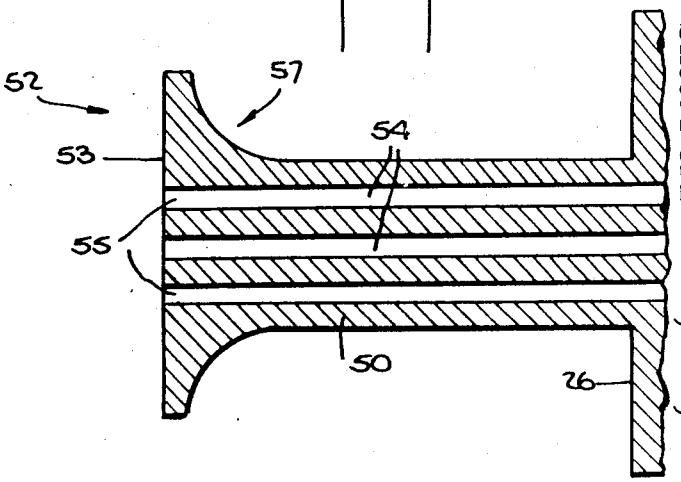
FIG. 4 is a axial section view in enlarged detail of the enlarged tip and the front stepped section of the atomizer of FIG. 1.

The ultrasonic atomizer 11 depicted in FIG. 1 is of generally tubular configuration and includes an axially extending liquid feed passage 12 similar to the one described in aforementioned U.S. Pat. No. 4,352,459. The main liquid feed tube itself (not shown) or a liquid feed tube 14 coupled to the main liquid feed tube is axially received in the atomizer and extends axially through the rear section 16, the driving elements 18, 19 and the electrode 20, to the front section 22. The rear section 16 includes an axial bore or passage 23; the driving elements 18, 19 and the electrode 20 are of annular configuration having a central opening or passage therethrough; and the front section includes an axial bore or passage 24.

The axial passages 23, 24 in the rear and front sections, respectively, and the openings in the driving elements and the electrode are coaxially disposed to form the liquid feed passage referenced generally by 12 and extending from the rear section to the larger diameter portion 26 of the front section. The axial passage 24 in the front section includes a threaded portion 28 and the tube 14 also includes a threaded portion 29 so that the tube can be threaded into the front section. The tube 14 is further provided with an annular flange or step 31 spaced from the threaded portion 29, and the rear section is also provided with an annular flange or step 33 disposed adjacent the driving means. Flanges 31 and 33 engage upon threading the tube 14 into threaded portion 28 of the front section.

The driving elements 18, 19 and electrode 20 sandwiched between flanged portions 38, 39 of the front and rear sections, respectively, are securely clamped therein by a plurality of assembly bolts 41 which pass through holes in one of the flanged portions 38, 39 and are threaded in holes in the other flanged portion to allow the two flanged portions to be clamped together. The driving elements and electrode can be insulated from the tube 14 by interior tubular insulator 43 and the driving elements and electrode can be sealed by exterior insulators 45. The driving elements and electrode can also be insulated and sealed in other ways.

The bolts 41 are made of titanium alloy and possess high strength and high mechanical compliance. Titanium alloy bolts have been found to be vastly superior to hardened steel bolts for fastening the flanged portions 38, 19 together, particularly when the ultrasonic atomizer utilizes large tips. Due to the exceptionally large quantities of energy transferred to the bolts during the atomizing process when large tips are used, the use of titanium alloy bolts quite surprisingly essentially eliminates bolt fracture and even more surprisingly provides significant atomizer energy savings. It is believed that the hardened steel bolts previously used did not have sufficient mechanical compliance and therefore fractured when subjected to stress. The titanium alloy bolts can also be used with other transducers even if they are not subjected to high stresses and surprisingly will reduce power consumption.

The threaded joint of the liquid feed tube 14 and the front section 22 can be sealed by applying joint compound or a sealant to the threads, or in other ways. The tube 14 can also be sealed with respect to the rear section 16, if desired. Further details of clamping, insulating and sealing arrangements, and mounting of the tube 14 in the axial passage can be found in aforementioned U.S. Pat. No. 4,352,459.

The front section 22 includes the larger diameter section 26, a stepped, smaller diameter section 50 and an enlarged, flanged, disc-shaped tip 52 which includes a planar, circularly-shaped atomizing surface 53 and a disc thickness or axial length 49. The axial passage 24 in the front section extends in the larger section 26 almost to the stepped section 50, thereby extending the axial liquid feed passage 12 to the stepped portion.

The stepped section 50 and the flanged tip are solid except for a plurality of passages 54 axially extending in the stepped section from the axial passage 24 to a corresponding plurality of orifices 55 in the atomizing surface 53 of the flanged tip. The precise location in the larger section 26 at which the larger passage 24 terminates and the smaller axial passages 54 begin is not critical. Liquid introduced through tube 14 enters the axial passage 24 which feeds the individual smaller passages 54. The diameter of the stepped section 50 is approximately equal to the diameter of the axial passage 24 in the larger section 26 and is substantially less than the diameter of the larger section 26 so as to provide amplification of the magnitude of the acoustical waves transmitted to the stepped section corresponding to the ratio of the square of the diameters as described more fully below. The relationship between the diameters of the stepped section 50, the larger section 26 and the axial passage 24 is not critical. The total cross-sectional area of the smaller axial passages 54 is less than that of the axial passage 24, and the cross-section areas of the smaller passages are equal to each other and to that of the associated orifice, although these relationships are also not critical.

A transition 57 of gradually increasing diameter is provided between the stepped section 50 and the flanged tip 52. The transition depicted in FIG. 1 is flared and is to a certain extent critical as described in more detail below. The transition has been found to eliminate structural failures in the stepped section, and its connections to the flanged tip and the larger section. Such failures were caused by stresses resulting from non-uniform vibrations and transverse flexing, and by inherent structural weaknesses or faults.

Figure 3:
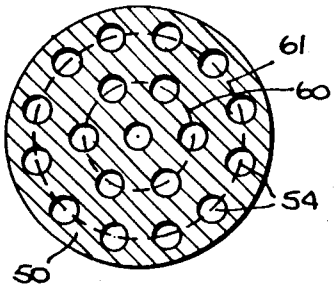
FIG. 3 is an enlarged section view of the ultrasonic atomizer of FIG. 1 taken along line 3—3 of FIG. 1.
Figure 2:
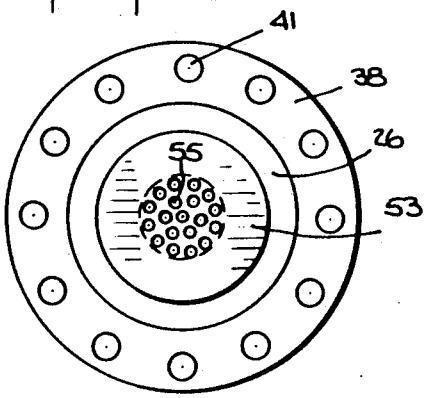
FIG. 2 is a front view in enlarged detail of the ultrasonic atomizer of FIG. 1.

In the pattern of the orifices 55 in the atomizing surface 53 depicted in FIG. 3, the orifices are disposed about the circumferences of two concentric circles 60, 61. Six equally spaced orifices are disposed about the circumference of the inner circle 60 and twelve equally spaced orifices are disposed about the circumference of the outer circle 61. The orifices disposed about the inner circle are offset from those disposed about the outer circle. Preferably, each orifice on the inner circle is disposed midway between an adjacent pair of orifices on the outer circle, i.e., a radius extending through an orifice disposed about inner circle 60 falls midway between radii extending through adjacent orifices disposed about the outer circle 61. While the orifice pattern depicted in FIG. 3 is preferred for an atomizer not including a barrier, it is not critical and other patterns may be utilized.

The orifice pattern depicted in FIG. 3 provides a generally cylindrical or slightly conical spray pattern, as do other orifice arrangements in which the orifices are centrally located and generally equally spaced apart. The diameter of the generally cylindrical spray pattern is approximately equal to the diameter of the flanged tip 52.

It has been found that the atomizer described herein operates particularly well in a vertical orientation with the tip facing upwardly and in horizontal orientations.

Although the larger diameter flanged tip, the flared transition, and the titanium bolts are illustrated herein with an ultrasonic atomizer of the type disclosed in aforementioned U.S. Pat. No. 4,352,459, they can be used with other types of ultrasonic atomizers, for example, the type disclosed in aforementioned U.S. Pat. No. 4,153,201.

A mathematical analysis of an atomizer front section of the type depicted in FIG. 1 will now be described with reference to FIGS. 5–8. As used in the art, the term "stepped-horn" refers to a front horn section, the portion of which depicted in FIG. 7 includes a stepped smaller diameter section of diameter $d_1$ and a larger diameter section of diameter $d_0$. The portion of the front section depicted in FIG. 7 is a half wavelength amplifying section in which the stepped and larger sections are each of quarter wavelength and in which the gain in amplitude is equal to the ratio of cross-sectional areas of the larger section (area $=\pi d_0^2/4$) and the stepped section (area $=\pi d_1^2/4$), or simply the ratio of the squares of the diameters $d_0/d_1$.

The lengths of the sections are taken such that the transition point between the two diameters is a nodal plane for the longitudinal standing wave pattern and both ends of the amplifying section are anti-nodes, the exposed end of the stepped section in FIG. 7 being the atomizing surface.

In the present analysis, only the quarter-wave length, smaller diameter, stepped section between the node and the left hand anti-node is considered. Since that section is of uniform diameter, the wave equation analysis is trivial. When flanged atomizing surfaces are considered, the wave equation analysis becomes significantly more complex.

Mathematical analysis of "stepped horn" sections may also be found in aforementioned U.S. Pat. No. 4,337,896, the disclosure of which is incorporated herein by reference, and in aforementioned U.S. Pat. No. 4,153,201.

The present analysis considers a flared neck transition from the stepped section leading to a flanged disc tip with a flat atomizing surface, as depicted in FIG. 5. The flared transition is important when dealing with a large flanged disc tip (in the neighborhood of 2 inches) because of the possibility of cantilevering of the flanged disc tip if the transition between the stepped section and the flanged disc is an abrupt step, as depicted in FIG. 6.

The results of cantilevering can be catastrophic because the bending stresses promote fatigue which can lead to stress cracking in the region where the stepped section joins the flanged disc. This cantilevering effect is not present in most ultrasonic atomizers since the flanged disc tip is not particularly large relative to the stepped section diameter and the flanged disc thickness is adequate to discourage flexure. However, for a given frequency and where the diameter of the flanged disc tip is increased in order to raise the flow rate capacity, the remaining dimensions of the front section, i.e. the diameters of the stepped section and the larger diameter section remain unchanged. These constraints are a consequence of the basic geometry of a given size front section. Increasing diameters (other than that of the flanged disc tip) results in decreased gain and the introduction of an unwanted transverse mode of oscillation. The combination of a fixed diameter for the stepped section and an enlarged flanged disc tip diameter introduces the possibility for cantilevering. The flared neck transition eliminates the potential for bending without affecting materially the gain characteristics of the front section.

As shown in FIG. 8, a filleted transition can be provided between the stepped section and the larger diameter section to enhance atomizer performance. The filleted transition can be subjected to a mathematical analysis similar to that of the flared transition described below.

To calculate the length of the quarter-wavelength section from the nodal plane at the step to the atomizing surface, it is convenient to break up that section into three regions as shown in FIG. 8. Region ① is the flanged disc tip atomizing section of uniform radius $r_1$ and thickness b. Region ② is the flared transition in the shape of a quadrant of a circle with radius $r_o$. Region ③ is the stepped portion, excluding the flared section, of uniform radius $R_1$ and length "a". The quantity $R_1$ is known at the outset as is $r_1$, the flared disc tip radius. Since $r_o=r_1-R_1$, the flare radius $r_o$ can be determined. The only selectable parameters remaining then are the flanged disc tip thickness "b" and the stepped section length "a". Since the whole section must be equivalent to a quarter-wavelength, only one of these two parameters is independent; the other must be calculated. Since it is more convenient to choose a flanged disc tip thickness "b", the value for "a", the stepped section length excluding the flared transition region ②, is computed corresponding to an overall section length equal to a quarter-wavelength.

For convenience, the origin of the horizontal axis is taken at the intersection of regions ① and ②. The atomizing surface then is at $x=-x_1$; the transition region ② extends from $x=0$ to $x=x_2$ (or $x_2=r_o$); the stepped section length excluding the flared transition region extends from $x=x_2$ to $x=x_3$, a length "$a$"$=x_3-x_2$.

The governing time-independent wave equation for all regions is $$\frac{d}{dx}\left[S_i(x)\frac{d\eta}{dx}(x)\right] = -\frac{\omega}{c}S_i(x)\eta_i(x) \tag{1}$$

where $\eta_i(x)$ is the wave displacement from equilibrium in the ith region (i=1, 2, 3) at any point x in that region; $S_i(x)$ is the cross sectional area at any point x in the region; $\omega$ is the circular frequency at which the atomizer is operating ($\omega=2\pi f$), and c is the speed of sound in the medium.

In regions ① and ③, where $S_1$ and $S_3$ are constant, and, therefore, independent of x, equation (1) reduces to the simple harmonic oscillator equation. For $S_i$ independent of x $$\frac{d}{dx}\left[S_i\frac{d\eta_i}{dx}(x)\right] = S_i\frac{d^2\eta_i}{dx} = -\frac{\omega}{c}S_i\eta_i(x)$$

and cancelling $S_i$ on both sides, $$\frac{d^2\eta_i(x)}{dx^2} = -\frac{\omega}{c}\eta_i(x). \tag{2}$$

Solutions of equation (2) are of the form $$\eta_i(x)=A_i\cos kx+B_i\sin kx \quad i=1, 3 \tag{3}$$

where $k=\omega/c$ and $A_i$ and $B_i$ are arbitrary solution constants. The solution in region ② is much more involved since the cross-sectional area is not constant. Moreover, the differential equation is not solvable by any convenient analytical means. Thus a numerical solution is required.

Before discussing the solution for region ②, it is helpful to formally state the complete problem and the steps taken to solve it.

The solutions for $\eta_i$ in each of the three regions are:

$$\eta_1(x)=A_1\cos kx+B_1\sin kx \quad -x_1\leqq x\leqq 0 \tag{4a}$$

$$\eta_2(x) \text{ to be determined } 0\leqq x\leqq x_2 \tag{4b}$$

$$\eta_3(x)=A_3\cos kx+B_3\sin kx \quad x_2\leqq x\leqq x_3 \tag{4c}$$

with boundary conditions $$\eta_1'(-x_1)=0 \tag{5a}$$

$$\eta_1(0)=\eta_2(0) \tag{5b}$$

$$\eta_1'(0)=\eta_2'(0) \tag{5c}$$

$$\eta_2(x_2)=\eta_3(x_2) \tag{5d}$$

$$\eta_2'(x_2)=\eta_3'(x_2) \tag{5e}$$

$$\eta_3(x_3)=0. \tag{5f}$$

Equation (5a) stipulates that the flanged disc is an antinode, since the first derivative with respect to x, which is proportional to the stress, vanishes.

Equation (5f) is a statement that there is a nodal plane at the step located at $x=x_3$. The remaining conditions, equations (5b) athrough (5e) are expressions of continuity of both displacement and stress at the boundaries between regions.

The technique used to obtain a full solution proceeds as follows:

(a) Solve equation (4a) for region ① using boundary condition (5a) and assuming an arbitrary value of unity for the maximum displacement (at the flanged disc).

(b) Using the fact that the displacement and stress are continuous across the boundary between regions ① and ②, the starting values in region ②, namely $\eta_2(0)$ and $\eta'_2(0)$, can be found by evaluating $\eta$, (0) and $\eta'_1(0)$.

(c) A numerical solution is developed in region ② by use of the Runge-Kutta method. Starting with the computed value of $\eta_2(0)$ and $\eta'_2(0)$, the method employed uses certain finite difference equations to calculate $\eta_2$ and $\eta'_2$ at a point which is a small, pre-selected distance $\Delta x$ from the starting point. These new values, $\eta_2(\Delta x)$ and $\eta'_2(\Delta x)$ are then used to fine $\eta_2$ and $\eta'_2$ at a point $\Delta x$ further away or at $x=2\Delta x$. The process is repeated, using the same $\Delta x$ each time until the values for $\eta_2$ and $\eta'_2$ at $x=x_2$ are found. Naturally, the smaller the value of $\Delta x$ chosen, the more accurate the result. The number of iterations required, N is equal to $$N=r_o/\Delta x.$$

Thus, for example, in the case where $r_0=1.0$ inch, choosing $x=0.01$ inch would involve 100 iterations, an easy task on any small computer.

(d) Having computed $\eta_2(x_2)$ and $\eta'_2(x_2)$, it is now an easy task to calculate "a", since by equations (5d) and (5e) the initial values of $\eta_3$ and $\eta'_3$ at $x=x_2$ are known, and by equation (5f), the end condition is known at $x=x_3$.

The actual mathematical treatment for each of the three regions follows:

Region ①

The solution in this region is sinusoidal, $$\eta_1(x)=A_1 \cos kx+B_1 \sin kx \quad -x_1 \leqq x \leqq 0.$$

From equation (5a), $$\eta'_1(-x_1)=-A_1 \cos(-kx_1)+B_1 \sin(-kx_1)=0$$

or $$A_1 \cos kx_1+B_1 \sin kx_1=0. \tag{6}$$

The assumption is made that $\eta_1(-x_1)=1$. Thus, $$\eta_1(-x_1)=A_1 \cos(-kx_1)+B_1 \sin(-kx_1)=1$$

or $$A_1 \cos kx_1-B_1 \sin kx_1=1. \tag{7}$$

Solving equations (6) and (7) simultaneously for $A_1$ and $B_1$, $$A_1=\cos kx_1 \tag{8a}$$

$$B_1=-\sin kx_1. \tag{8b}$$

Therefore, at x=0, the other end region ①, $$\eta_1(0)=A_1 \cos 0+B_1 \sin 0=A_1$$

or $$\eta_1(0)=\cos kx_1. \tag{9}$$

Also, $$\eta'_1(0)=-A_1 k \sin 0+B_1 k \cos 0=kB_1$$

or $$\eta'_1(0)=-k \sin kx_1. \tag{10}$$

Equations (9) and (10) establish the starting values for region ② via the boundary condition expressions $\eta_1(0)=\eta_2(0)$ and $\eta'_1(0)=\eta'_2(0)$.

Region ②

In the analysis for region ② the differential equation (equation (1)) in terms of the relevant parameters is determined. It will be convenient for this portion of the analysis to drop the subscript②from the displacement parameter; thus $\eta_2(x)$ will be referred to as $\eta(x)$.

The flared transition has a radius $r_o$. The flanged disc radius $r_1$ is the sum of the stepped section radius $R_1$ and the flared transition section radius $r_o$, $$r_1=R_1+r_o.$$

By geometric considerations $$r(x)=r_1-(r_o^2-(r_o-x)^2)^{\frac{1}{2}} \quad 0 \leqq x \leqq x_2. \tag{11}$$

The cross-sectional area as a function of x, $S_2(x)$ is then $$S_2(x)=\pi r^2(x)=\pi[r_1^2+r_o^2-(r_o-x)^2-2r_1(r_o-(r_o-x)^2)^{\frac{1}{2}}]. \tag{12}$$

It is this quantity which is substituted into the generalized wave equation, equation (1) for the case of variable cross-sectional area in order to solve that equation. However, the expression given by equation (12) is quite unwieldy. A change of variables will simplify subsequent calculations.

Using the angular function $\theta$ with respect to the flared transition region as a new variable, $$x=r_o(1-\cos\theta). \tag{13}$$

In terms of $\theta$, equation (12) becomes $$S_2(\theta)=\pi(r_1-r_o \sin\theta)^2. \tag{14}$$

The wave equation for region 2 is given by $$\frac{d}{dx}\left[S_2(x)\frac{d\eta}{dx}(x)\right]=-kS_2(x)\eta(x).$$

Differentiating the left-hand side and rearranging terms, the following is obtained:

$$\frac{d^2\eta(x)}{dx^2}+\frac{1}{S_2(x)}\frac{dS_2(x)}{dx}\frac{d\eta(x)}{dx}+k^2\eta(x)=0. \tag{15}$$

The quantity $$\frac{1}{S_2(x)}\frac{dS_2(x)}{dx}=\frac{d}{dx}(\ln S_2(x))$$

so that $$\frac{d^2\eta(x)}{dx^2}+\frac{d}{dx}[\ln S_2(x)]\frac{d\eta(x)}{dx}+k^2\eta(x)=0 \tag{16}$$

The change in independent variables requires some computation. In equation (13) there is a linear relationship between the variables x and cos $\theta$. Thus, it is simpler to deal with cos $\theta$ as new variable rather than $\theta$ itself.

According to standard transformation theory $$\frac{d}{dx}=\frac{d}{dx}(\cos\theta)\frac{d}{d(\cos\theta)} \tag{17a}$$

$$\frac{d^2}{dx^2}=\frac{d^2}{dx^2}(\cos\theta)\frac{d}{d}(\cos\theta)+\left[\frac{d}{dx}(\cos\theta)\right]^2\frac{d^2}{d(\cos\theta)^2} \tag{17b}$$

From equation (13)

$$\frac{d(\cos\theta)}{dx}=-\frac{1}{r_o} \text{ and } \frac{d^2(\cos\theta)}{dx^2}=0.$$

Therefore $$\frac{d}{dx}=-\frac{1}{r_o}\frac{d}{d(\cos\theta)}$$

and $$\frac{d^2}{dx}=\frac{1}{r_o^2}\frac{d^2}{d(\cos\theta)^2}$$

Substituting these results into equation (16) and for the moment writing $\eta(\cos\theta)$ as $\eta$, $$\frac{d^2\eta}{d(\cos\theta)^2} + \frac{d(\ln S_2(\cos\theta))}{d(\cos\theta)} \frac{d\eta}{d(\cos\theta)} + r_o^2k^2\eta = 0. \tag{18}$$

Taking the natural logarithm of $S_2(\cos\theta)$ from equation (14) and differentiating, $$\frac{d^2\eta}{d(\cos\theta)} + \frac{2r_o\cos\theta}{[r_1 - r_o(1-\cos\theta)^{\frac{1}{2}}](1-\cos^2\theta)^{\frac{1}{2}}} \frac{d\eta}{d(\cos\theta)} + k^2r_o^2\eta = 0. \tag{19}$$

This form, although tractable, can further be simplified by a second change of variables in which $$y=(1-\cos^2\theta)^{\frac{1}{2}}=\sin\theta. \tag{20}$$

In the interest of brevity, it may simply be stated that the final result after this transformation in which equations (17a) and (17b) have been employed to transform from cos $\theta$ to y is $$\frac{d^2\eta}{dy^2} = \left[\frac{1}{y} + \frac{2(1-y^2)}{\frac{r_1}{r_o} - y}\right] \frac{1}{1-y^2} \frac{d\eta}{dy} - \frac{k^2r_oy^2}{1-y^2}\eta \tag{21}$$

The range of values of the original coordinate x is $0 \leqq x \leqq r_o$; the range of y is therefore $0 \leqq y \leqq 1$.

Equation (21) is not solvable by analytical means. The simplest method of obtaining a solution is by the use of a numerical method. The fourth order Runge-Kutta Method for differential equations of second order is a suitable technique. In this method, the differential equation is written in the form $$\eta_{n+1} = \eta_n + h\left[\frac{d\eta_n}{dy} + \frac{1}{6}(k_1 + k_2 + k_3)\right] \tag{23a}$$

$$\frac{d\eta_{n+1}}{dy} = \frac{d\eta_n}{dy} + \frac{1}{6}(k_1 + 2k_2 + 2k_3 + k_4) \tag{23b}$$

where $$k_1 = hf\left(y_n, \eta_n, \frac{d\eta_n}{dy}\right) \tag{23c}$$

$$k_2 = hf\left(y_n + \tfrac{1}{2}h, \eta_n + \frac{h}{2}\frac{d\eta_n}{dy} + \frac{h}{8}k_1, \frac{d\eta_n}{dy} + \frac{k_1}{2}\right)$$

$$k_3 = hf\left(y_n + \tfrac{1}{2}h, \eta_n + \frac{h}{2}\frac{d\eta_n}{dy} + \frac{h}{8}k_1, \frac{d\eta_n}{dy} + \frac{k_2}{2}\right) \tag{23e}$$

$$k_4 = hf\left(y_n + h, \eta_n + h\frac{d\eta_n}{dy} + \frac{h}{2}k_3, \frac{d\eta_n}{dy} + k_3\right). \tag{23f}$$

The interval h should be chosen small enough to ensure sufficient accuracy of the result. The computations are convenient in that evaluation of $\eta_{n+1}$ and $d\eta_{n+1}/dy$ involve only the immediately preceding quantities in n.

The assignment of initial values must be conducted with some care. Obviously $y_o=0$. The initial value for $\eta$, namely $\eta_o$ in the present notation, is that calculated and given by equation (9); $\eta_o \equiv (0) = \eta_1(0) = \cos kx_1$. The evaluation of $d\eta_o/dy$ at $y=0$ is not trivial. From an examination of equation (21) it might appear that f has a singularity at $y=0$ since the term $1/y$ appears in the coefficient for $d\eta/dy$. However, this is only an apparent singularity. Considering again the relationship between y and the original variable x, it can be seen that $y=(1-(1-xr_o)^2)^{\frac{1}{2}}$, so that relating $d\eta/dy$ with $d\eta/dx$ yields $$\frac{d\eta}{dy} = \frac{dx}{dy}\frac{d\eta(x)}{dx} = \frac{r_oy}{(1-y^2)^{\frac{1}{2}}}\frac{d\eta(x)}{dx}. \tag{24}$$

Thus, equation (21) can be written in the alternate form $$\frac{d^2\eta}{dy^2} = \left[1 + \frac{2y(1-y^2)}{r_1/r_o - y}\right]\frac{r_o}{(1-y^2)^{3/2}}\frac{d\eta}{dx}(x) - \frac{k^2r_oy}{1-y^2}\eta. \tag{25}$$

and the singularity has been removed. Since $d\eta(x)/dx$ $at=0$ is not zero and in fact is given by equation (10), $\eta'_1(0) = -k \sin kx_1$, equation (24) infers that $d\eta/dy=0$ when $y=0$. The initial values of the function $f(y,\eta,d\eta/dy)$ is $f(0,\eta_o,0)$, which from equation (25) is given by $$f(0,\eta_o,0) = r_o\eta'(0) = -r_ok \sin kx_1. \tag{26}$$

Next, the value for $f(0,\eta_o,0)$ is substituted into equations (23a) through (23f) to find $\eta_1$ and $d\eta_1/dy$. By iteration, successive values of $\eta_2$, $d\eta_2/dy$; . . . ; $\eta n$ $d\eta_n/dy$ can be found. The final values, $\eta_N$ and $d\eta_N/dy$, are those corresponding to the values at $x=x_2$ (or $y=1$). However, as the point $y=1$ is approached, the analysis degenerates because of the real singularity of f at $y=1$. This is readily seen from either equation (21) or (25) where the factor $1=y^2$ in the denominator of the coefficients for both and $d\eta/dy$ (or $d\eta/dx$) vanishes at $y=1$. Thus, in the actual numerical calculations, the iterations proceed to a point arbitrarily close to the end point and then $\eta$ and $d\eta/dx$ (not $d\eta/dy$) are extrapolated over the remaining small distance.

The calculated values of $\eta$ and $d\eta/dx$ at $x=x_2$ ($y=1$) becomes the initial values for the analysis in region ③ by equation (5d) and (5e).

Region ③

The solution in this region is again sinusoidal;

$$\eta_3(x) = A_3 \cos kx + B_3 \sin kx \quad x_2 \leqq x \leqq x_3.$$

From equation (5f)

$$\eta_3(x_3) = A_3 \cos kx_3 + B_3 \sin kx_3 = 0$$

or $$\tan kx_3 = A_3/B_3. \tag{27}$$

In order to find $x_3$, from which "a" can be calculated ($a=x_3-r_o$), boundary condition equations (5d) and (5e) at $x=x_2$ are used:

$$A_3 \cos kx + B_3 \sin kx = \eta_2(x_2) \tag{28a}$$

$$-kA_3 \sin kx + kB_3 \cos kx = \eta'_2(x_2) \quad (28b)$$

The values of $\eta_2(x_2)$ and $\eta'_2(x_2)$ are those numerically computed at the endpoint of region ② via the Runge-Kutta method, referred to there as $\eta$ and $d\eta/dx$ respectively at $x=x_2$. Simultaneous solutions of equations (28a) and (28b) for $A_3$ and $B_3$ give the result:

$$A_3 = \eta_2(x_2) \cos kx_2 - 1/k\eta'_2(x_2) \sin kx_2 \quad (29a)$$

$$B_3 = \eta_2(x_2) \sin kx_2 + 1/k\eta'_2(x_2) \cos kx_2. \quad (29b)$$

Substituting equations (29a) and (29b) into equation (27) results in the final expression for the determination of $x_3$ (or "a")

$$x_3 = \frac{1}{k} \tan^{-1} \left[ \frac{\frac{1}{k} \frac{\eta_2'(x_2)}{\eta_2(x_2)} \tan kx_2 - 1}{\frac{1}{k} \frac{\eta_2'(x_2)}{\eta_2(x_2)} + \tan kx_2} \right]. \quad (30)$$

EXAMPLE

An ultrasonic atomizer was designed for an operating frequency of 25 kHz, with an aluminum nozzle built in accordance with the invention.

The following dimensions were selected:

Flanged disc radius $r_1=1$ in.

Stepped section radius $R_1=0.0375$ in.

Flared transition radius $r_0=r_1-R_1=0.625$ in.

Flanged disc thickness "b"=0.125 in.

$k=\omega/c$ (at 25 kHz)=0.81178 in.$^{-1}$

Using these parameters, the starting values for region ②, $\eta_2(0)$ and $\eta'_2(0)$ are:

$$\eta_2(0)=0.99486 \text{ inch}$$

$$\eta'_2(0)=-0.082220.$$

Using the Runge-Kutta method, the initial value of f, i.e. $f(o,\eta_2(0),0)=r_o\eta'_2(0)=-0.051387$ inches. Proceeding through the numerical iterations in 100 steps of y (y=0 to 1) yields the following endpoint for region 2.

$$\eta_2(x_2)=0.52728 \text{ inch}$$

$$\eta'_2(x_2)=-1.314$$

The necessity to extrapolate $\eta'_2(x_2)$ results in a lower precision for that quantity.

Having found $\eta_2(x_2)$ and $\eta'_2(x_2)$, it is now possible to compute $x_3$ by the equations associated with region ③ with the result $x_3=1.013$ inches. Since $r_o=0.625$ inch, the value of the stepped section excluding the flared transition region is "$a$"$=1.013-0.625=0.388$ inch.

A multiple orifice ultrasonic atomizer constructed in accordance with the invention has been found to operate in excess of a 30 gph flow rate.

Certain changes and modifications of the disclosed embodiments of the present invention will be readily apparent to those skilled in the art. It is the applicants' intention to cover by their claims all those changes and modifications which could be made to the embodiments of the invention herein chosen for the purpose of disclosure without departing from the spirit and scope of the invention.

What is claimed is:

1. In an ultrasonic liquid atomizer a front section comprising a larger section, a stepped, smaller section coupled to the larger section and an enlarged tip coupled to the stepped section, the enlarged tip atomizing surface thereon, a plurality of orifices disposed in the atomizing surface through which liquid is delivered to the atomizing surface, one or more liquid feed passages extending through the stepped section and communicating with the orifices, common rearward passage means for feeding liquid to the liquid feed passages, and a transition in diameter from the stepped section to the enlarged tip along a path defined by the circumference of a circle having a predetermined radius.

2. The front section according to claim 1 and comprising a corresponding plurality of individual liquid feed passages axially extending in the stepped section each in communication with a respective orifice, and a common liquid feed passage in the larger section which communicates with all of the individual passages.

3. The front section according to claim 2 wherein the front section is of generally stepped tubular configuration, the enlarged tip is disc-shaped and all the orifices are disposed within the circumference of a circle having a diameter less than that of the enlarged tip.

4. The front section according to claim 1 wherein the disc-shaped tip is defined by a radius $r_1$ and a given axial length $x_1$, the stepped section is defined by a radius $R_1$ and an axial length "a" to be determined, and the transition is defined by a radius $r_1$-$R_1$ and a given axial length $x_2$, and wherein "a" is determined by solving the differential equation $$a = \frac{d}{dx}\left[ S_i(x) \frac{d\eta_i(x)}{dx} \right] = -\omega S_i(x) \frac{\eta}{C} i(x), \; i = 1, 2, 3$$

where:

x is the distance from the intersection of the transition and the flanged disc tip in either direction;

$S_1(x)$, $S_2(x)$ and $S_3(x)$ are the cross section area at any point x in the disc-shaped tip, the transition and the stepped section, respectively;

$\eta_1(x)$, $\eta_2(x)$ and $\eta_3(x)$ are the wave displacement from equilibrium in the disc-shaped tip, the transition and the stepped section respectively;

$\omega$ is the circular frequency at which the front section is operating ($\omega=2\pi f$); and c is the speed of sound in the medium; subject to the following boundary conditions taking the intersection of the transition and the disc-shaped tip as the origin, $$\eta_1(x_1)=1,\ \eta'_1(-x_1)=0,\ \eta_1(0)=\eta_2(0),\ \eta'_1(0)=\eta'_2(0),$$
$$\eta_2(x_2)=\eta_3(x_2),\ \eta_2(x_2)=\eta'_3(x_2),\ \eta_3(x_3)=0,$$

where $x_3$ is the distance from the origin to the larger section.

5. A front section for an ultrasonic transducer comprising a larger section, a stepped, smaller section coupled to the larger section, an enlarged tip coupled to the stepped section, and a transition which gradually increases from the stepped section to the enlarged tip along a path defined by the circumference of a circle having a predetermined radius wherein the front section is of generally stepped tubular configuration and the enlarged tip is disc-shaped, wherein the enlarged tip is defined by a radius $r_1$, and a given axial length $x_1$, the stepped section is defined by a radius $R_1$ and an axial length a to be determined, and the transition is defined by a raidus $r_1=R_1$ and a given axial length $x_2$ and wherein "a" is determined by solving the differential equation:

$$\underline{a} = \frac{d}{dx}\left[S_i(x)\frac{d\eta_i(x)}{dx}\right] = -\frac{\omega}{C}S_i(x)\eta_i(x),\ i = 1, 2, 3$$

where:

x is the distance from the intersection of the transition and the flanged disc tip in either direction; $S_1(x)$, $S_2(x)$ and $S_3(x)$ are the cross section area at any point x in the disc-shaped tip, the transition and the stepped section, respectively; $\eta_1(x)$, $\eta_2(x)$, and $\eta_3(x)$, are the wave displacement from equilibrium in the disc-shaped tip, the transition and the stepped section respectively;

$\omega$ is the circular frequency at which the front section is operating ($\omega=2\pi f$); and c is the speed of sound in the medium; subject to the following boundary conditions taking the intersection of the transition and the disc-shaped tip as the origin, $$\eta_1(x_1)=1,\ \eta'_1(-x_1)=0,\ \eta_1(0)=\eta_2(0), \eta_1'(0)=\eta'_2(0),$$
$$\eta_2(x_2)=\eta_3(x_2),\ \eta_2(x_2)=\eta_3'(x_2),\ \eta_3(x_3)=0,$$

where $x_3$ is the distance from the origin to the larger section.

6. An ultrasonic liquid atomizer which includes the front section according to claim 5, the tip including an atomizing surface, the atomizer comprising at least one orifice in the atomizing surface and a liquid feed passage in the stepped section communicating therewith, and means for supplying liquid to the liquid feed passage.

7. An ultrasonic liquid atomizer comprising a front section, a rear section and driving means disposed between the two sections for imparting ultrasonic vibrations to the front section, the front section comprising a larger section and an enlarged tip coupled to the stepped section, the enlarged tip including a flat outermost atomizing surface thereon, at least one orifice disposed in the atomizing surface through which liquid is delivered to the atomizing surface, one or more liquid feed passages extending through the stepped section and communicating with the orifice, a common rearward passage means for feeding liquid to the liquid feed passages, and a transition coupling the enlarged tip to the stepped section, the transition gradually increasing in size from the stepped section to the enlarged tip.

8. The ultrasonic liquid atomizer according to claim 7 wherein the front section of the atomizer is of generally stepped tubular configuration and the enlarged tip is disc-shaped.

9. The ultrasonic liquid atomizer according to claim 8 and comprising a plurality of orifices in the atomizing surface through which liquid is delivered to the atomizing surface, and a corresponding plurality of individual liquid feed passages axially extending in the stepped section each in communication with a respective orifice, and a common liquid feed passage in the larger section which communicates with all of the individual passages.

10. The ultrasonic liquid atomizer according to claim 8 wherein the transition gradually increases in diameter from the stepped section to the enlarged tip.

11. The ultrasonic liquid atomizer according to claim 8 wherein all the orifices are disposed within the circumference of a circle having a diameter substantially less than that of the disc-shaped tip.

* * * * *